US006951285B1

(12) United States Patent
Anderson

(10) Patent No.: US 6,951,285 B1
(45) Date of Patent: Oct. 4, 2005

(54) AIR SUSPENSION GRAIN CLEANER SYSTEM

(76) Inventor: Dean R. Anderson, 11066 81st St. NE., Fairdale, ND (US) 58229

( * ) Notice: Subject to any disclaimer, the term of this patent is extended or adjusted under 35 U.S.C. 154(b) by 56 days.

(21) Appl. No.: 10/623,007

(22) Filed: Jul. 17, 2003

(51) Int. Cl.[7] ..... B07B 7/00
(52) U.S. Cl. ..... 209/146; 209/143; 209/154
(58) Field of Search ..... 209/134–138, 209/139.1, 142, 143, 146, 154, 715, 718, 209/935

(56) References Cited

U.S. PATENT DOCUMENTS

| | | | | |
|---|---|---|---|---|
| 393,411 | A * | 11/1888 | Willis | 209/139.1 |
| 971,608 | A * | 10/1910 | Hedfeldt | 209/137 |
| 1,506,494 | A * | 8/1924 | Lycurgus | 209/137 |
| 3,756,406 | A | 9/1973 | Khan | |
| 4,384,953 | A | 5/1983 | Christian | |
| 4,401,128 | A | 8/1983 | Fisher | |
| 4,750,997 | A | 6/1988 | Hoppe | |
| 4,840,727 | A | 6/1989 | Humphrey | |
| 4,874,411 | A | 10/1989 | Snauwaert et al. | |
| 4,887,400 | A | 12/1989 | Carroll | |
| 5,019,242 | A | 5/1991 | Donelson | |
| 5,098,557 | A | 3/1992 | Hirschler et al. | |
| 5,123,542 | A | 6/1992 | Hoppe | |
| 5,181,616 | A | 1/1993 | Le Gigan | |
| 5,248,344 | A | 9/1993 | Hoppe | |
| 5,376,046 | A | 12/1994 | Shuknecht et al. | |
| 6,405,405 | B1 * | 6/2002 | Hauch | 15/309.2 |

FOREIGN PATENT DOCUMENTS

| | | |
|---|---|---|
| GB | 2310582 | 3/1997 |

* cited by examiner

*Primary Examiner*—Donald P. Walsh
*Assistant Examiner*—Joseph C. Rodriguez

(57) ABSTRACT

An air suspension grain cleaner system for efficiently cleaning grain in small applications. The air suspension grain cleaner system includes a frame, a cleaning chamber, a blower unit fluidly connected to a lower portion of the cleaning chamber, a grain inlet fluidly connected to the cleaning chamber, an exhaust chamber fluidly connected to an upper portion of the cleaning chamber, a cleaning damper within the cleaning chamber, and an exhaust damper within the exhaust chamber. A first control member is preferably positioned between the grain inlet and the cleaning chamber to prevent pressurized air from passing through the grain inlet.

20 Claims, 5 Drawing Sheets

AIR SUSPENSION GRAIN CLEANER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to grain cleaners and more specifically it relates to an air suspension grain cleaner system for efficiently cleaning grain in small applications.

2. Description of the Related Art

Grain cleaners have been in use for years for cleaning debris and undesirable seeds from grain. Impure grain can result in lowered price per bushel when sold, hence, many individuals attempt to clean their grain before selling it on the open mark.

There are two main types of grain cleaners utilized: large-scale commercial grain cleaners and small-scale non-commercial grain cleaners. There are various types of large-scale grain cleaners, however their application to small-scale operations (e.g. a farm) are not feasible. In addition, large-scale grain cleaners are not suitable for transporting to different locations.

Small-scale grain cleaners are typically comprised of an auger unit with a screen within for "screening" out debris and undesirable seeds from the grain. However, small-scale grain cleaners are not efficient in the removal of debris or undesirable seeds thereby resulting in an impure grain product.

Examples of patented devices which may be related to the present invention include U.S. Pat. No. 4,384,953 to Christian; Patent GB2,310,582 to Ryan; U.S. Pat. No. 5,019,242 to Donelson; U.S. Pat. No. 4,840,727 to Humphrey; U.S. Pat. No. 3,756,406 to Khan; U.S. Pat. No. 5,123,542 to Hoppe; U.S. Pat. No. 5,181,616 to Le Gigan; U.S. Pat. No. 5,248,344 to Hoppe; U.S. Pat. No. 5,376,046 to Shuknecht et al.; U.S. Pat. No. 5,098,557 to Hirschler et al.; U.S. Pat. No. 4,887,400 to Carroll; U.S. Pat. No. 4,874,411 to Snauwaert et al.; U.S. Pat. No. 4,750,997 to Hoppe; and U.S. Pat. No. 4,401,128 to Fisher.

While these devices may be suitable for the particular purpose to which they address, they are not as suitable for efficiently cleaning grain in small applications. Conventional grain cleaners are not efficient and suitable for small applications such as upon farms.

In these respects, the air suspension grain cleaner system according to the present invention substantially departs from the conventional concepts and designs of the prior art, and in so doing provides an apparatus primarily developed for the purpose of efficiently cleaning grain in small applications.

BRIEF SUMMARY OF THE INVENTION

In view of the foregoing disadvantages inherent in the known types of grain cleaners now present in the prior art, the present invention provides a new air suspension grain cleaner system construction wherein the same can be utilized for efficiently cleaning grain in small applications.

The general purpose of the present invention, which will be described subsequently in greater detail, is to provide a new air suspension grain cleaner system that has many of the advantages of the grain cleaners mentioned heretofore and many novel features that result in a new air suspension grain cleaner system which is not anticipated, rendered obvious, suggested, or even implied by any of the prior art grain cleaners, either alone or in any combination thereof.

To attain this, the present invention generally comprises a frame, a cleaning chamber, a blower unit fluidly connected to a lower portion of the cleaning chamber, a grain inlet fluidly connected to the cleaning chamber, an exhaust chamber fluidly connected to an upper portion of the cleaning chamber, a cleaning damper within the cleaning chamber, and an exhaust damper within the exhaust chamber. A first control member is preferably positioned between the grain inlet and the cleaning chamber to prevent pressurized air from passing through the grain inlet.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an air suspension grain cleaner system that will overcome the shortcomings of the prior art devices.

A second object is to provide an air suspension grain cleaner system for efficiently cleaning grain in small applications.

Another object is to provide an air suspension grain cleaner system that may be utilized in small applications.

An additional object is to provide an air suspension grain cleaner system that may be easily transported.

A further object is to provide an air suspension grain cleaner system that utilizes pressurized air to clean the grain.

Another object is to provide an air suspension grain cleaner system that is easily controlled to accommodate various types of grain.

A further object is to provide an air suspension grain cleaner system that is economical for farm usage.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
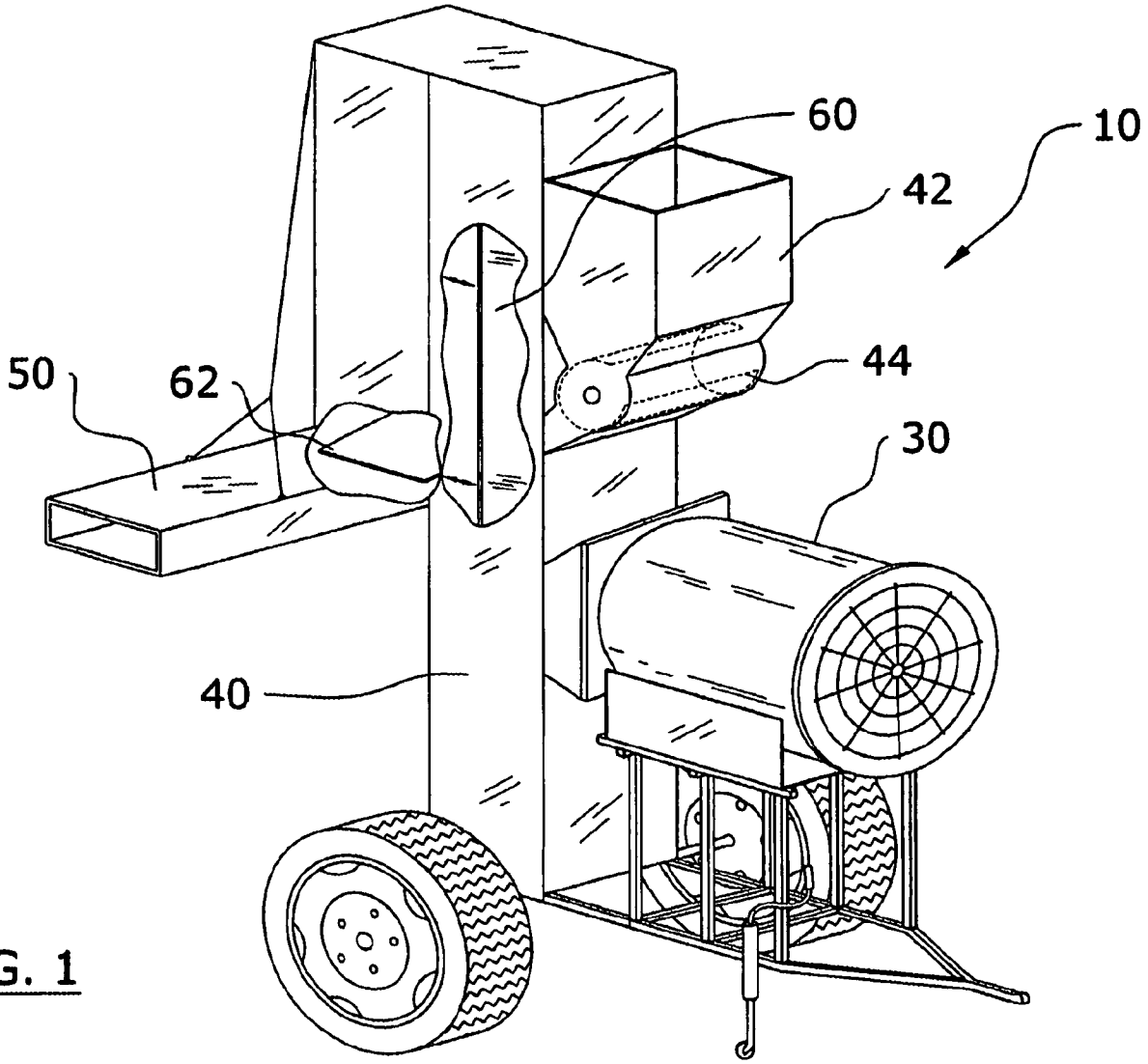
FIG. 1 is an upper perspective view of the present invention.

Turning now descriptively to the drawings, in which similar reference characters denote similar elements throughout the several views, FIGS. 1 through 5*b* illustrate an air suspension grain cleaner system 10, which comprises a frame 20, a cleaning chamber 40, a blower unit 30 fluidly connected to a lower portion of the cleaning chamber 40, a grain inlet 42 fluidly connected to the cleaning chamber 40, an exhaust chamber 41 fluidly connected to an upper portion of the cleaning chamber 40, a cleaning damper 60 within the cleaning chamber 40, and an exhaust damper 62 within the exhaust chamber 41. A first control member 44 is preferably positioned between the grain inlet 42 and the cleaning chamber 40 to prevent pressurized air from passing through the grain inlet 42.

B. Frame

The frame 20 may be comprised of any structure capable of supporting and transporting the present invention. The frame 20 preferably includes a plurality of wheels and a hitch structure for allowing easy transportation to remote locations. FIGS. 1 through 5*c* of the drawings illustrate an exemplary frame 20, however various other structures and designs may be utilized to construct the frame 20.

C. Cleaning Chamber

The cleaning chamber 40 preferably has a vertically aligned tubular structure as shown in FIGS. 1 through 4 of the drawings. The cleaning chamber 40 may have various lengths, widths, cross sectional shapes and sizes as can be appreciated. The cleaning chamber 40 preferably extends in a vertical manner, however the cleaning chamber 40 may extend at various angles as can be appreciated.

Figure 4:
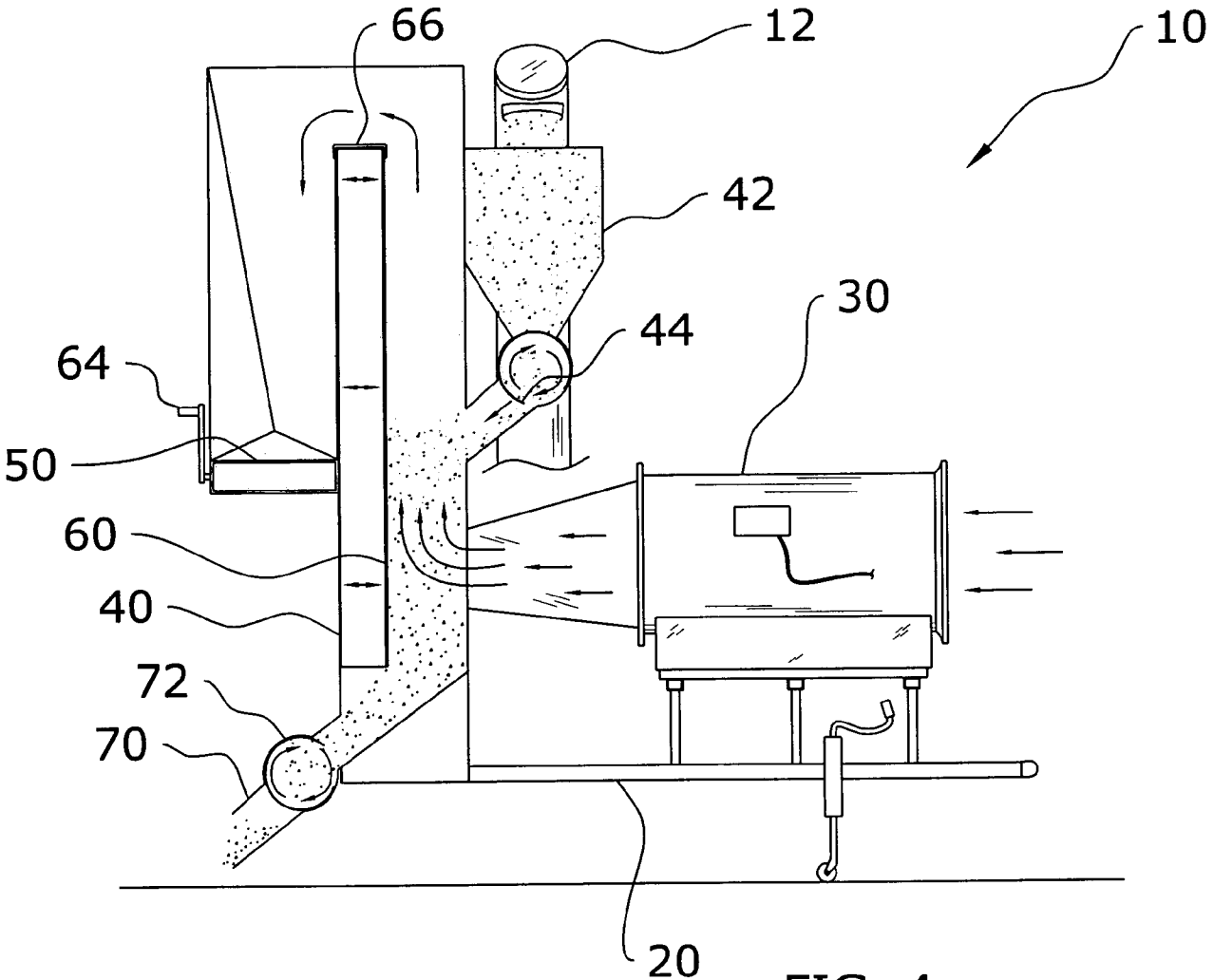
FIG. 4 is a side cutaway view of the present invention illustrating operation thereof with increased air velocity.
Figure 5B:
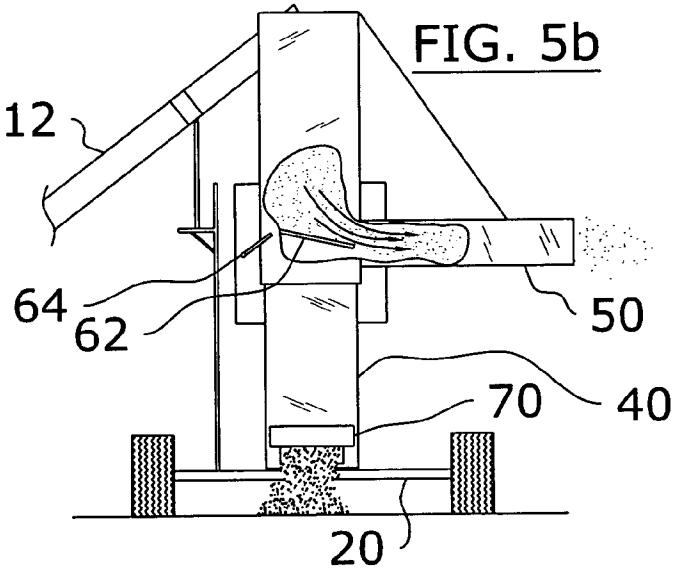
FIG. 5*b* is a rear partial cutaway view of the present invention with the second baffle partially closed.
Figure 5C:
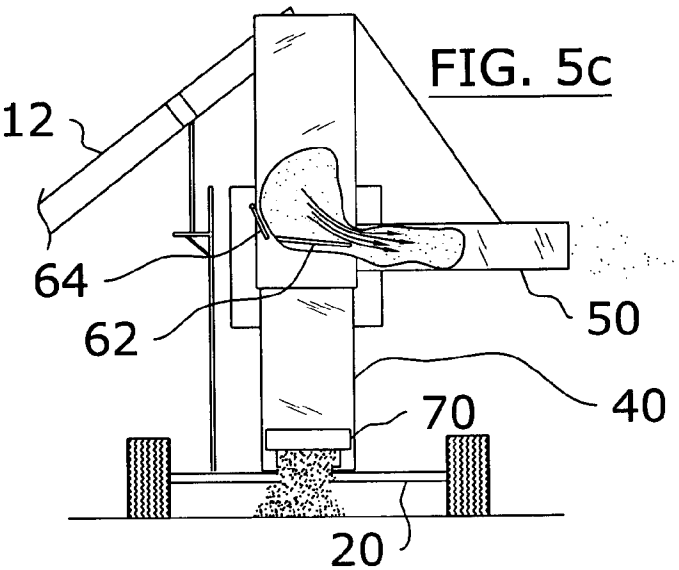
FIG. 5*c* is a rear partial cutaway view of the present invention with the second baffle partially closed.
Figure 5A:
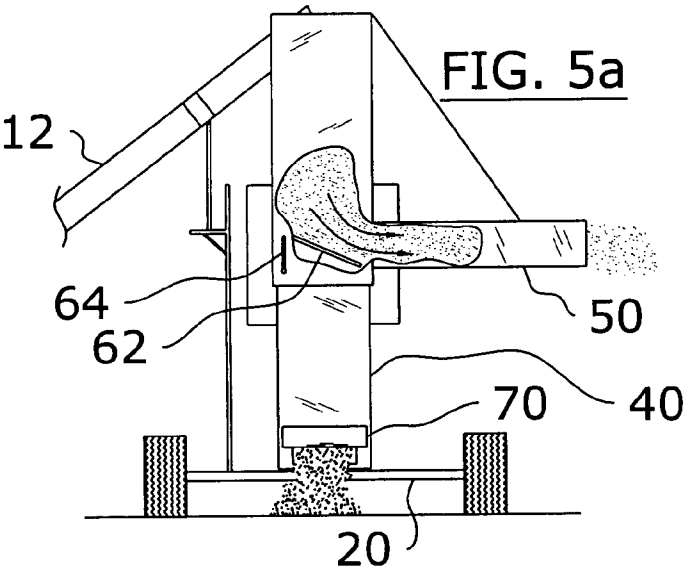
FIG. 5*a* is a rear partial cutaway view of the present invention with the second baffle completely open.

A grain chute 70 is fluidly connected to a lower portion of the cleaning chamber 40 as shown in FIG. 4 of the drawings. The grain chute 70 allows the heavier grain to be dispensed and collected outside of the cleaning chamber 40. The grain chute 70 preferably has a second control member 72 similar to the first control member 44 within the grain inlet 42 as discussed below for maintaining air pressure within the cleaning chamber 40.

D. Blower Unit

The blower unit 30 is fluidly connected to a lower portion of the cleaning chamber 40 to provide pressurized air into the lower portion of the cleaning chamber 40. The blower unit 30 may be comprised of any structure capable of providing a pressurized volume of air into the cleaning chamber 40. The blower unit 30 may be powered electrically, hydraulically or mechanically from a tractor.

E. Grain Inlet

The grain inlet 42 is fluidly connected to a central portion of the cleaning chamber 40 as shown in FIG. 4 of the drawings. The grain inlet 42 allows a conventional auger 12 to input contaminated grain into the cleaning chamber 40.

Figure 3:
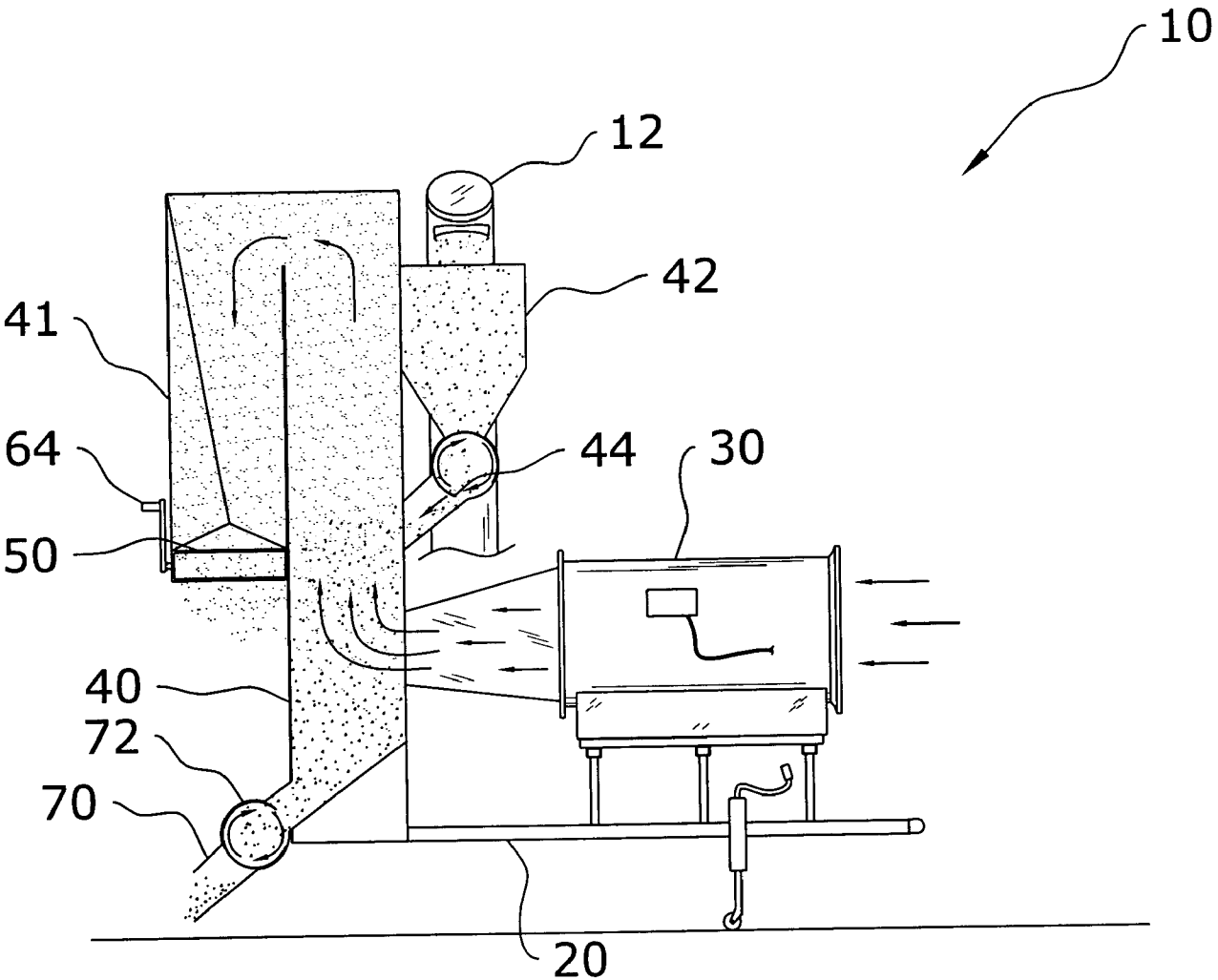
FIG. 3 is a side cutaway view of the present invention illustrating operation thereof.

As shown in FIGS. 3 and 4 of the drawings, a first control member 44 is positioned between the grain inlet 42 and the cleaning chamber 40 to prevent pressurized air from passing through the grain inlet 42. The first control member 44 is a tubular member rotated by a motor unit that has a longitudinal slot for receiving grain and for dispensing grain into the cleaning chamber 40 without significantly reducing air pressure within the cleaning chamber 40.

F. Exhaust Chamber

The exhaust chamber 41 is fluidly connected to an upper portion of the cleaning chamber 40 as shown in FIGS. 3 and 4 of the drawings. The exhaust chamber 41 may have a similar cross section and size to the cleaning chamber 40, however different cross sections and sizes may be utilized. A material chute 50 is fluidly connected to the exhaust chamber 41 for dispersing the waste material into a separate container external of the exhaust chamber 41.

G. Exhaust Damper

As shown in FIGS. 1, 5*a*, 5*b* and 5*c* of the drawings, an exhaust damper 62 is positioned within the exhaust chamber 41. The exhaust damper 62 is preferably comprised of a plate member pivotally attached within the exhaust chamber 41 and is preferably positioned near an exhaust opening within the exhaust chamber 41.

Figure 2:
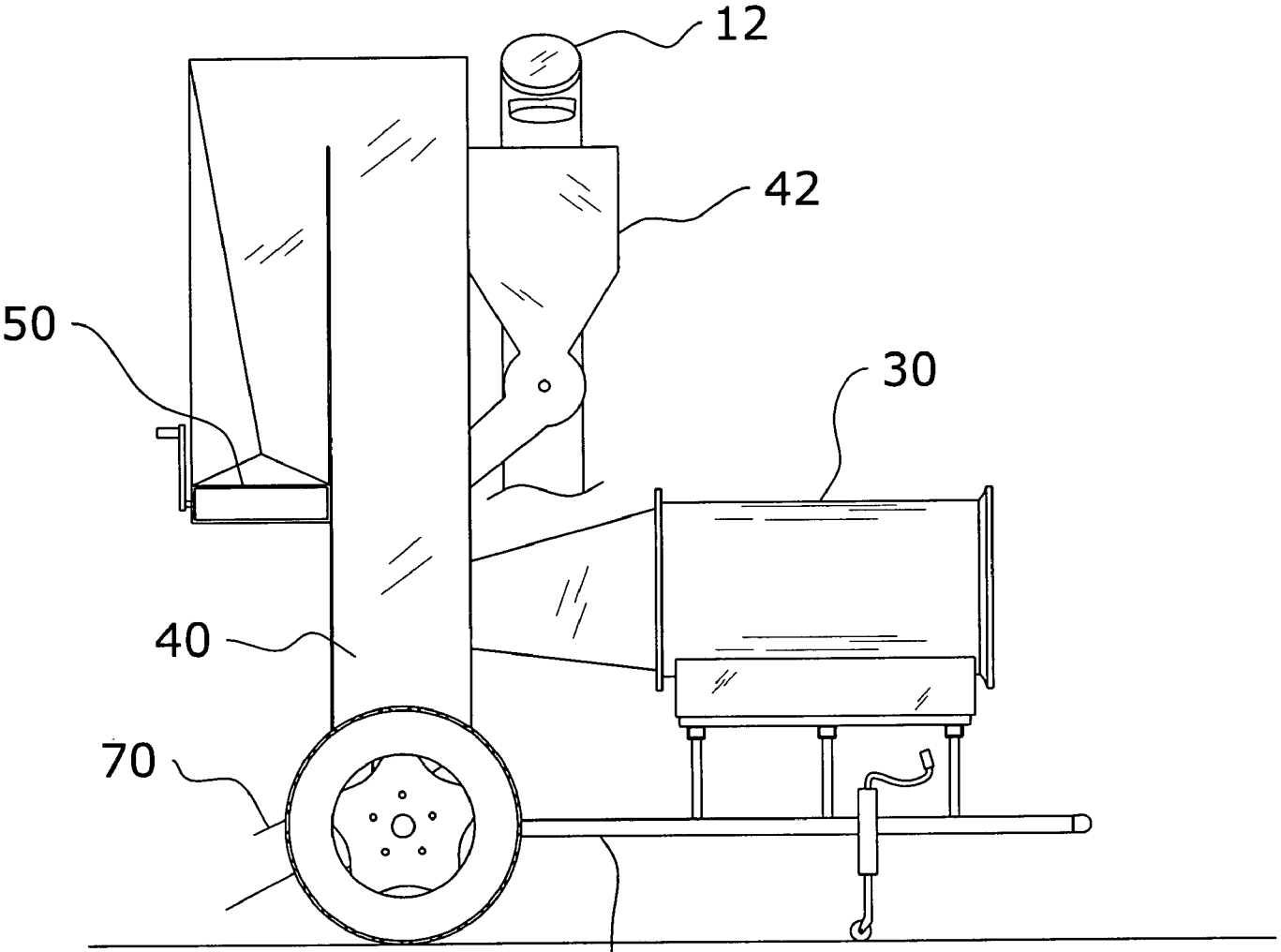
FIG. 2 is a side view of the present invention.

The exhaust damper 62 controls the air velocity and air pressure within the cleaning chamber 40 as desired. An adjustment handle 64 is mechanically connected to the exhaust damper 62 for controlling a position of the exhaust damper 62 as shown in FIGS. 2 through 4 of the drawings. Various other control structures may be utilized to control the exhaust damper 62.

H. Cleaning Damper

As shown in FIG. 4 of the drawings, a cleaning damper 60 is preferably positioned within the cleaning chamber 40. The cleaning damper 60 is comprised of a vertical wall member that extends inwardly to reduce the cross sectional size of the cleaning chamber 40 and outwardly to increase the cross sectional size of the cleaning chamber 40.

As shown in FIG. 4 of the drawings, a cap member 66 is attached to the upper portion of the wall member and a wall of the cleaning chamber 40 to prevent debris from collecting behind the cleaning damper 60. The cap member 66 may be attached directly by the user, or the cap member 66 may be comprised of an elastic or flexible material permanently attached.

I. Operation of the Invention

In use, contaminated grain is input into the grain inlet 42 and then enters the first control member 44 through the opening within the first control member 44. As the first control member 44 rotates within the grain inlet 42, the opening is then exposed to the cleaning chamber 40 where after the grain enters the cleaning chamber 40.

As the grain enters the cleaning chamber 40, the air flow from the blower unit 30 elevates the lighter material within the grain upwardly within the cleaning chamber 40 as shown in FIGS. 3 and 4 of the drawings. The lighter material is then exhausted through the exhaust chamber 41 out the material chute 50 as shown in FIG. 1 of the drawings.

The heavier grain falls to the lower portion of the cleaning chamber 40 to the grain chute 70. A second control member 72 within the grain chute 70 receives the cleaned grain and dispenses the cleaned grain without significantly reducing air pressure within the cleaning chamber 40. This process continues until the desired amount of grain is cleaned.

The cleaning damper 60 allows the user to control the volume of the cleaning chamber 40 and air flow velocity within the cleaning chamber 40 by reducing the effective cross sectional size of the cleaning chamber 40. The cleaning damper 60 may be extended via conventional mechanical means. By closing the exhaust damper 62, the user is able to reduce the volume of airflow, reduce the velocity of airflow, and increase the air pressure (i.e. reduces the turbulence within the cleaning chamber 40) thereby removing less material. By opening the exhaust damper 62, the user is able to increase the volume of airflow, increase the velocity of airflow, and reduce the air pressure (i.e. increases the turbulence within the cleaning chamber 40) thereby removing more material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air suspension grain cleaner system, comprising:

a frame;

a cleaning chamber attached to said frame;

a blower unit fluidly connected to a lower portion of said cleaning chamber;

a grain inlet fluidly connected to said cleaning chamber;

an exhaust chamber fluidly connected to an upper portion of said cleaning chamber;

a cleaning damper within said cleaning chamber, wherein said cleaning damper is comprised of a wall member that extends inwardly to reduce the cross sectional size of said cleaning chamber; and a cap member attached to the upper portion of said wall member and a wall of said cleaning chamber.

2. The air suspension grain cleaner system of claim 1, including an exhaust damper within said exhaust chamber.

3. The air suspension grain cleaner system of claim 2, wherein said exhaust damper is comprised of a plate member.

4. The air suspension grain cleaner system of claim 2, wherein said exhaust damper is positioned near an exhaust opening within said exhaust chamber.

5. The air suspension grain cleaner system of claim 2, wherein said exhaust damper controls the airflow within said cleaning chamber.

6. The air suspension grain cleaner system of claim 2, including an adjustment handle mechanically connected to said exhaust damper for controlling a position of said exhaust damper.

7. The air suspension grain cleaner system of claim 1, including a first control member positioned between said grain inlet and said cleaning chamber to prevent pressurized air from passing through said grain inlet.

8. The air suspension grain cleaner system of claim 7, wherein said first control member is a tubular member rotated by a motor unit that has a longitudinal slot for receiving grain and for dispensing grain into said cleaning chamber without significantly reducing air pressure within said cleaning chamber.

9. An air suspension grain cleaner system, comprising:

a cleaning chamber having a vertically aligned tubular structure;

a blower unit fluidly connected to a lower portion of said cleaning chamber;

a grain inlet fluidly connected to said cleaning chamber;

an exhaust chamber fluidly connected to an upper portion of said cleaning chamber;

an exhaust damper within said exhaust chamber; and a first control member positioned between said grain inlet and said cleaning chamber to prevent pressurized air from passing through said grain inlet, wherein said first control member is a tubular member rotated by a motor unit that has a longitudinal slot for receiving grain and for dispensing grain into said cleaning chamber without significantly reducing air pressure within said cleaning chamber.

10. The air suspension grain cleaner system of claim 9, including a cleaning damper within said cleaning chamber.

11. The air suspension grain cleaner system of claim 10, wherein said cleaning damper is comprised of a wall member that extends inwardly to reduce the cross sectional size of said cleaning chamber.

12. The air suspension grain cleaner system of claim 11, including a cap member attached to the upper portion of said wall member and a wall of said cleaning chamber.

13. The air suspension grain cleaner system of claim 9, wherein said exhaust damper is comprised of a plate member.

14. The air suspension grain cleaner system of claim 9, wherein said exhaust damper is positioned near an exhaust opening within said exhaust chamber.

15. The air suspension grain cleaner system of claim 9, wherein said exhaust damper controls the airflow within said cleaning chamber.

16. The air suspension grain cleaner system of claim 9, including an adjustment handle mechanically connected to said exhaust damper for controlling a position of said exhaust damper.

17. An air suspension grain cleaner system, comprising:

a frame;

a cleaning chamber attached to said frame;

a blower unit fluidly connected to a lower portion of said cleaning chamber;

a grain inlet fluidly connected to said cleaning chamber;

an exhaust chamber fluidly connected to an upper portion of said cleaning chamber;

a cleaning damper within said cleaning chamber; and a first control member positioned between said grain inlet and said cleaning chamber to prevent pressurized air from passing through said grain inlet, wherein said first control member is a tubular member rotated by a motor unit that has a longitudinal slot for receiving grain and for dispensing grain into said cleaning chamber without significantly reducing air pressure within said cleaning chamber.

18. The air suspension grain cleaner system of claim 17, including an exhaust damper within said exhaust chamber.

19. The air suspension grain cleaner system of claim 18, wherein said exhaust damper controls the airflow within said cleaning chamber.

20. The air suspension grain cleaner system of claim 17, wherein said cleaning damper is comprised of a wall member that extends inwardly to reduce the cross sectional size of said cleaning chamber.

* * * * *